US006112683A

United States Patent [19]

Francesco

[11] Patent Number: 6,112,683

[45] Date of Patent: Sep. 5, 2000

[54] SET TO BE APPLIED TO AN AUTOMATIC PROGRAMMABLE SEWING UNIT SO AS TO ALLOW DARTS TO BE SEMI-AUTOMATICALLY SEWN

[76] Inventor: Ventrella Francesco, Viale Della Repubblica, 47, I-70017 Putignano, Italy

[21] Appl. No.: 09/142,944

[22] PCT Filed: Mar. 24, 1997

[86] PCT No.: PCT/EP97/01486

§ 371 Date: Sep. 18, 1998

§ 102(e) Date: Sep. 18, 1998

[87] PCT Pub. No.: WO97/37074

PCT Pub. Date: Oct. 9, 1997

[30] Foreign Application Priority Data

Apr. 2, 1996 [IT] Italy ..... BA96A0016

[51] Int. Cl.[7] ..... D05B 35/08

[52] U.S. Cl. ..... 112/147

[58] Field of Search ..... 112/475.06, 475.09, 112/144, 145, 146, 148, 136, 132, 134, 135, 147

[56] References Cited

U.S. PATENT DOCUMENTS

| | | | |
|---|---|---|---|
| 354,101 | 12/1886 | Couchois | 112/146 |
| 385,560 | 7/1888 | Laubscher | 112/146 |
| 870,219 | 11/1907 | Boye | 112/134 X |
| 4,079,682 | 3/1978 | Nishiwaki | 112/144 X |
| 5,148,760 | 9/1992 | Miyauchi | 112/146 X |
| 5,261,340 | 11/1993 | Conley, Jr. et al. | 112/114 X |

*Primary Examiner*—Ismael Izaguirre
*Attorney, Agent, or Firm*—Harrison & Egbert

[57] ABSTRACT

A device for semi-automatically sewing darts on garments having a set formed by a flat lance, a plate-like rod and a translation plate driven by a feed mechanism of an automatic programmable sewing unit. Fabrics are folded upon the flat lance and held to the translation plate by the plate-like rod such that the fabrics do not touch the working surface of the sewing unit. First and second guide members move the flat lance and the plate-like rod in a coordinated manner to effect the dart sewing process.

10 Claims, 5 Drawing Sheets

FIG. 1A
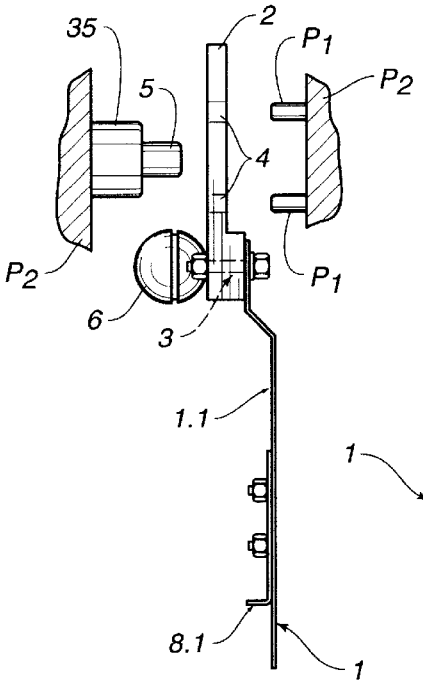
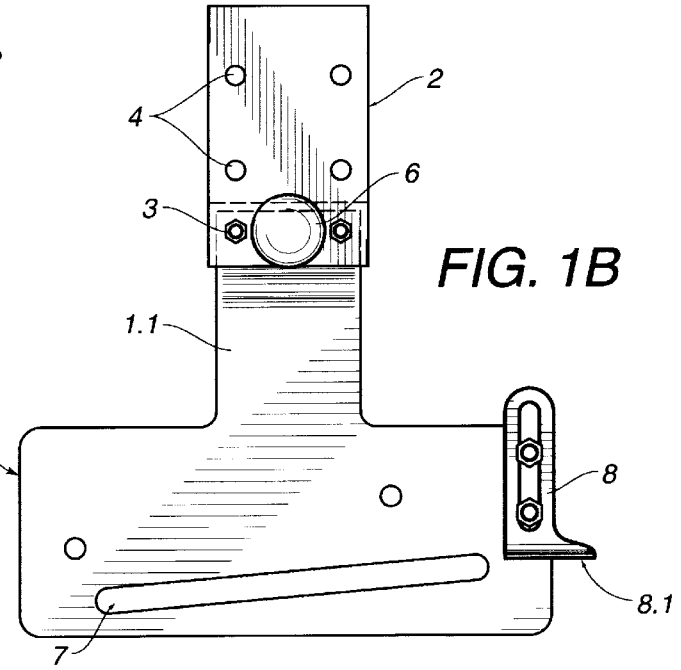
FIG. 1B
FIG. 2A
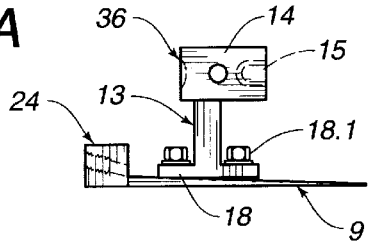
FIG. 3A
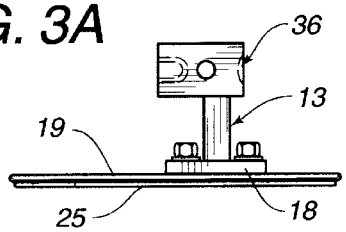
FIG. 2B
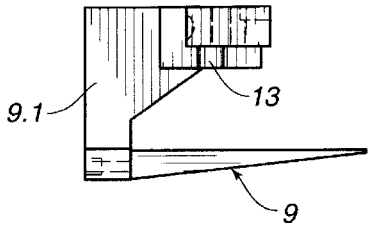
FIG. 3B
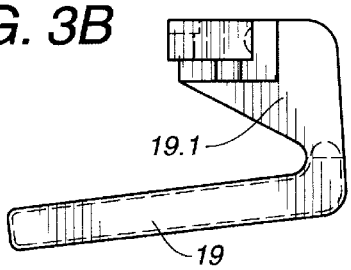

FIG. 16A
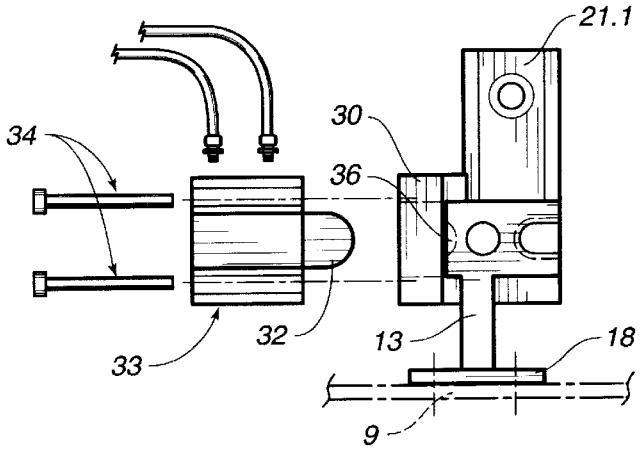
FIG. 16B
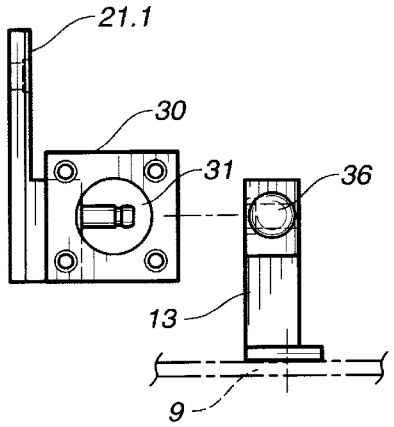
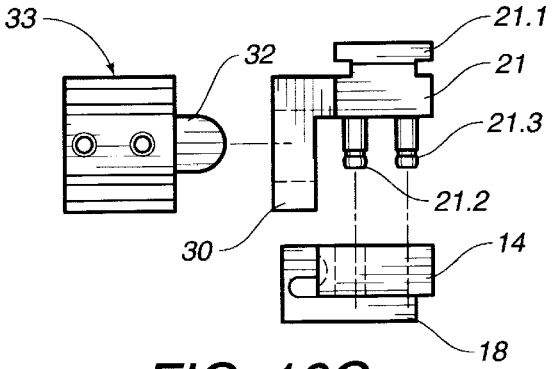
FIG. 16C
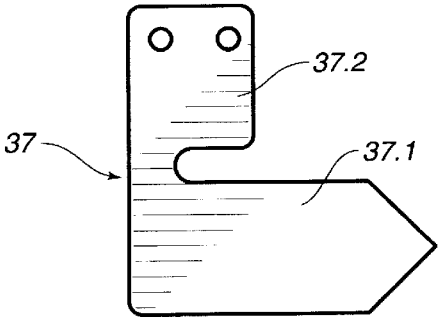
FIG. 17A
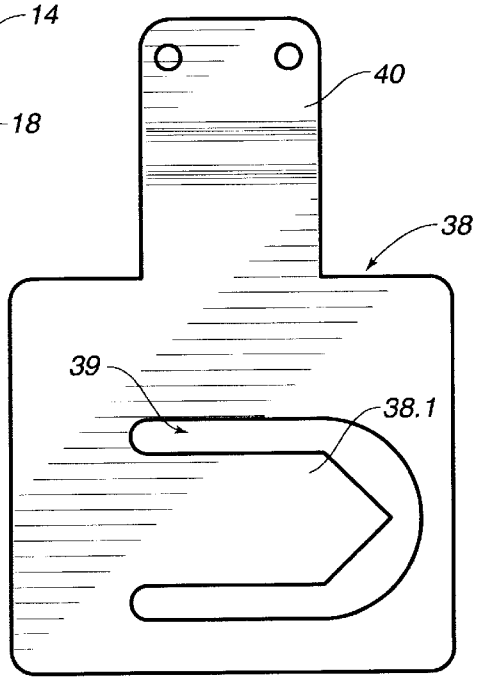
FIG. 17B

SET TO BE APPLIED TO AN AUTOMATIC PROGRAMMABLE SEWING UNIT SO AS TO ALLOW DARTS TO BE SEMI-AUTOMATICALLY SEWN

TECHNICAL FIELD

The invention refers to a semi-automatic dart sewing set.

BACKGROUND OF THE INVENTION

The automatic dart sewing units of the prior art do have several drawbacks since, during the dart sewing operation, fabrics are held to the working surface by means of a counter clamp while sliding over the surface.

The result is that fabrics are not steadily held during the sewing operation and, consequently, darts often turn out irregular in shape and size.

A further drawback is that the automatic dart sewing units do not carry out the sewing of darts at a distance of 10 to 15 millimeters from a pocket opening in trousers or skirts since, because of their structure, it is not possible to hold fabrics to the plate which carries them under the counter clamp by which, in turn, the fabrics are held to the working surface.

More generically, the units do not allow fabrics to be quickly applied nor to be easily positioned under the needle of the sewing machine.*

(*) Document U.S. Pat. No. 5,264,340 refers to a method and apparatus for sewing labels, that solve the problem to easily change the sewing template whenever the type of label to be sewn on the workpiece is changed.

SUMMARY OF THE INVENTION

The present invention chiefly aims at providing a device to be applied to a semi-automatic sewing machine, by which it is possible to overcome the above drawbacks.

More generically, the invention aims at providing a means which makes it easier to carry out darts sewing by using a semi-automatic sewing machine, so as to multiply the uses of this type of machines while making easier the commercialization thereof.

Therefore, the invention solves the problem of the semi-automatic darts sewing by using a set which facilitates the accurate and rapid positioning of fabrics under the needle of the sewing machine and which, by avoiding the sliding of the fabrics over the working surface, allows them to be steadily held under said needle.

Moreover, the invention allows the set to get automatically blocked to the devices of the sewing machine which carry out the lifting and the positioning upon the work surface; the invention also allows fabrics to be automatically ejected at the end of the operation.

BRIEF DESCRIPTION OF THE DRAWINGS

The set and its application are illustrated by the enclosed drawings in a preferred embodiment likely to be improved, the drawings showing respectively:

FIGS. 1A and 1B shows the translation plate and a side-view of the plate;

FIG. 2A shows a side-view of a flat lanc, or rather, of the shaped tool, on which fabrics get folded, and the first guide member which allows the rapid blocking thereof to the feed mechanism of the sewing machine;

FIG. 2B shows a top view of the flat lance illustrated in FIG. 2*a;*

FIG. 3A shows a side-view of the plate like rod and the second guide member;

FIG. 3B shows a top view of the counter clamp;

FIG. 16A shows the device by which the flat lance and the plate-like rod get blocked to the feed device of the sewing machine;

FIG. 16B shows a bottom of the blocking device;

FIG. 16C shows a plan view of the blocking device;

FIG. 17A shows a different embodiment of the flat lance allowing the borders of the protruding end of waist-bands in skirts or trousers to be sewn on the reverse side;

FIG. 17B shows the translation plate which allows the protruding end of waist-bands to be sewn on the reverse side by using the clamp shown in FIG. 16*a.*

DETAILED DESCRIPTION OF THE INVENTION

Figure 5:
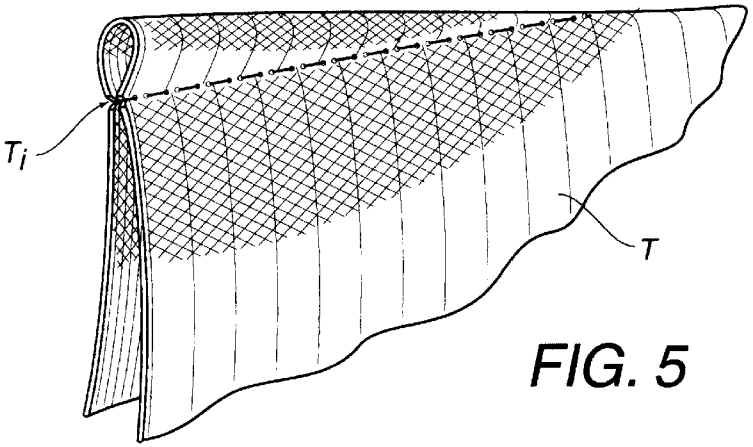
FIG. 5 shows the fabric on which a dart has been sewn.
Figure 6:
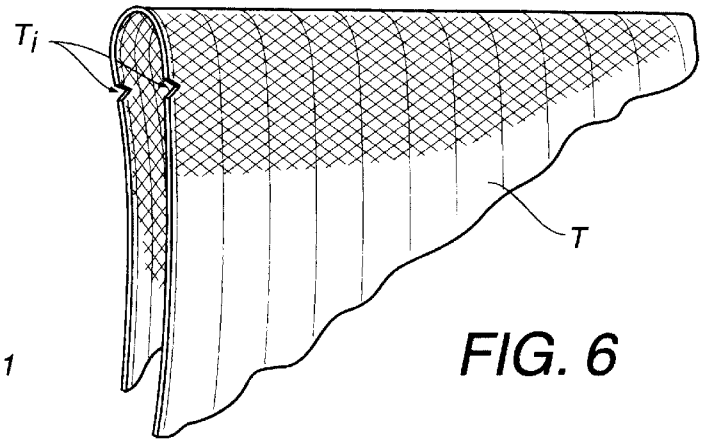
FIG. 6 shows the fabric having reference marks in the area where the dart is to be sewn.

The device subject of the present invention is essentially made up of:

- a translation plate supporting fabrics, which slides touching the sewing unit working surface by means of the feed mechanism of the sewing unit;
- a rod, i.e. a shaped little plate, also named flat lance, on which fabrics get folded;
- a plate-like rod serving for holding fabrics to the translation plate which moves them towards the needle of the sewing machine;
- a first and second guide members applied to the flat lance and to the plate-like rod so as to allow them to be semi-automatically applied to the feed mechanism of the sewing machine.

As it can be seen in FIGS. 1A and 1B, the translation plate 1 for angled darts has a rectangular shape and is connected to a supporting smaller plate 2 by means of an additional transversal element 1.1 and screws 3.

The supporting plate 2 gets positioned upon pins P1 of a horizontal plate P2 of the sewing machine under the feed mechanism, the pins being introduced into holes 4; the plate 2 is blocked by a piston 5 of a pneumatic type sliding inside a cylinder 35 integral with the supporting arm of the feed mechanism of the sewing machine.

Knob 6 does make it easier to hold plate 2 and to assemble it to the horizontal plate P2.

The translation plate is provided with a slot 7 allowing the needle of the sewing unit to pass through, and with a little plate 8 having an adjustable position in order to give fabrics a seat 8.1 when they are positioned upon the flat lance before the beginning of the dart sewing process.

Figure 4:
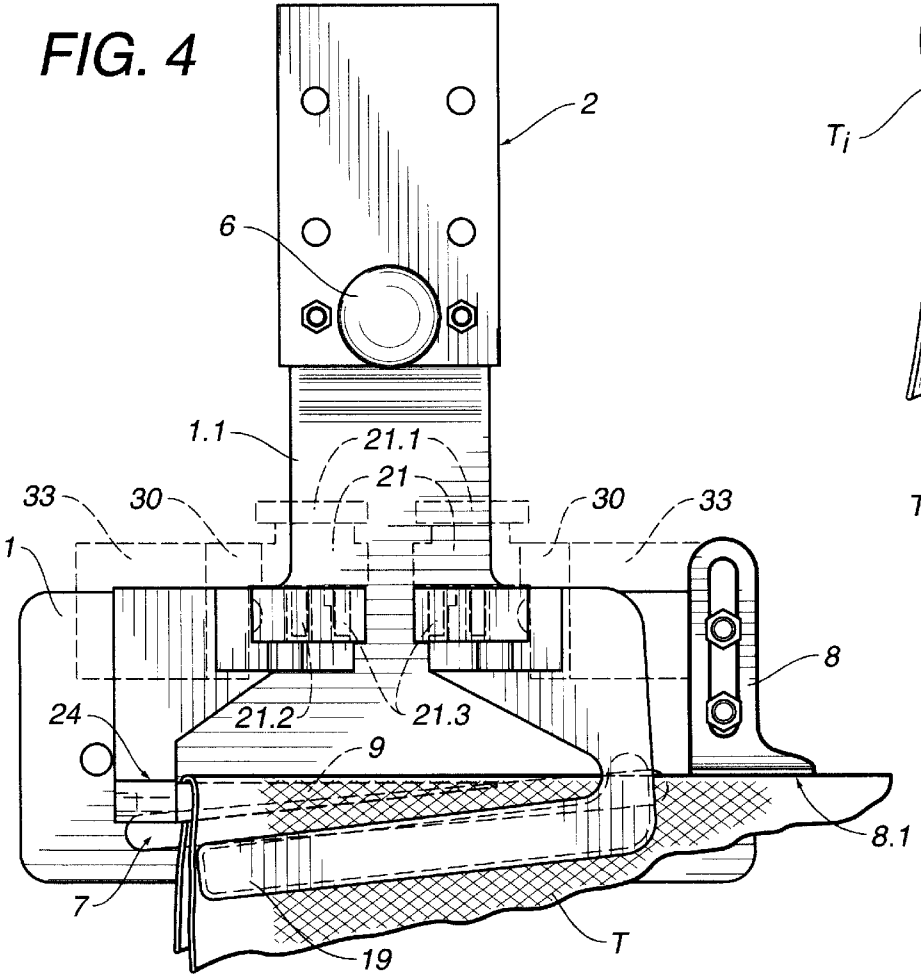
FIG. 4 shows the translation plate with the flat lance and plate-like rod positioned so as to carry out the sewing operation.
Figure 7D:
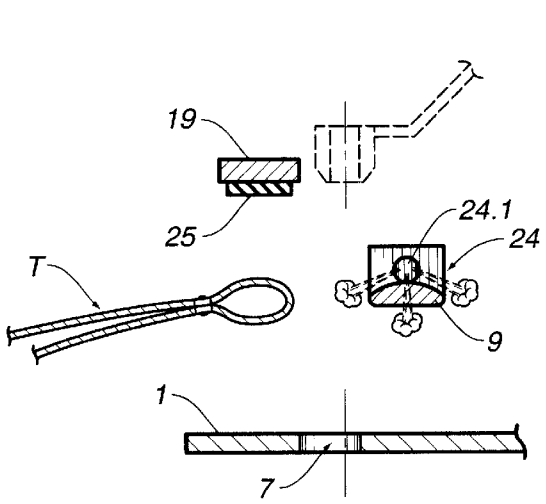
FIGS. 7A–D show the four phases of the dart sewing process.
Figure 7C:
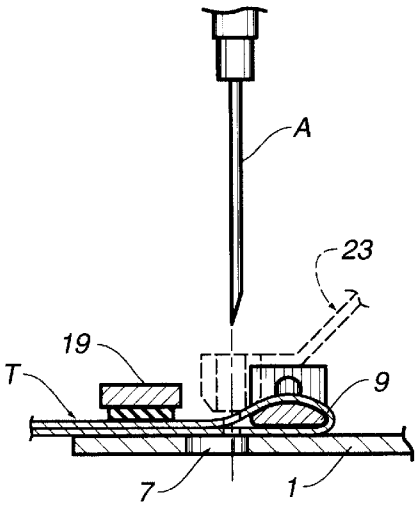
Figure 8:
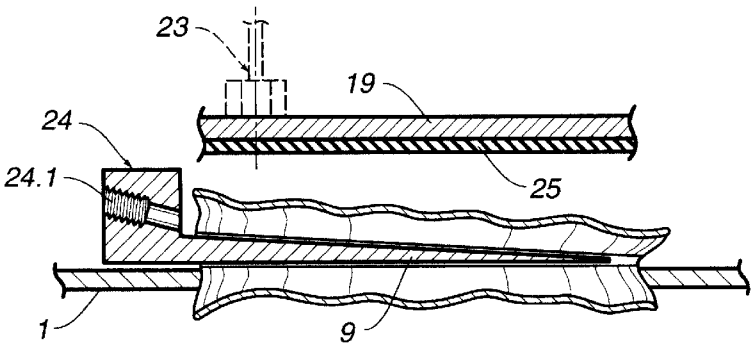
FIG. 8 shows a cross-sectional side view of the phase shown in FIG. 7B of phase b) of the above process.
Figure 7A:
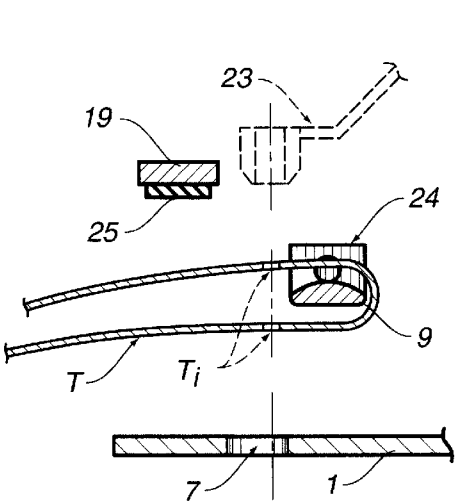
Figure 7B:
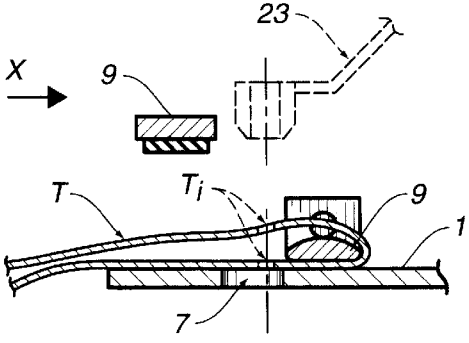
Figure 14:
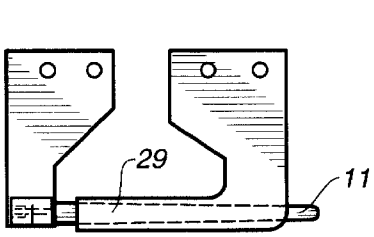
FIG. 14 shows the flat lance and the plate-like rod to be applied to the plate shown in FIG. 11 so as to carry out the dart sewing in proximity to pockets openings in trousers or skirts.
Figure 12:
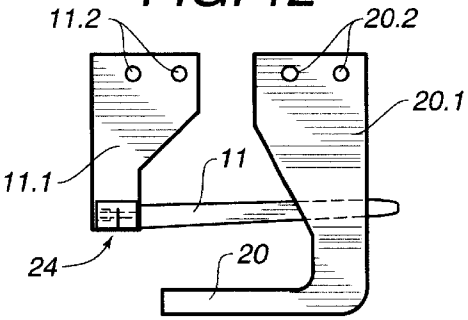
FIG. 12 shows the flat lance and the plate-like rod to be applied to the translation plate illustrated in FIG. 11.

The flat lance, on which the fabric has been folded, rests upon the plate 1, see FIGS. 4, 7*b* and 8, said flat lance being differently shaped according to the type of dart to be sewn, that is, it has a pointed shape, see reference 9 in FIGS. 2A and 2B, so as to get angled darts, it has a rounded end, see reference 10 in FIGS. 2A and 2B, so as to get straight closed darts, and it is shaped as in FIG. 12 and 14, see reference 11, so as to get straight open darts.

Each flat lance is provided with an additional plate-like element 9.1 having holes so as to let it be integral with a base plate 18 of a first guide member, by means of screws 18.1, see FIGS. 2A, 2B, 3A, 3B, 16A and 16B, the first guide member being made up of a vertical frame 13 joining, on the upper end, a block 14 which allows the application to a bearing device 21 integral with a little plate 21.1 vertically sliding inside a guide bearing of the feed mechanism of the sewing machine, so that each flat lance moves from the translation plate upwards and vice versa.

For this purpose, block 14 is provided with an eyelet 15 and with a hole 17 each receiving, respectively, pin 21.2 and pin 21.3 of the bearing device 21.

The bearing device is, in turn, integral with a plate 30 which is parallel to pins 21.2 and 21.3; plate 30 is provided with a hole 31 into which a pneumatic piston 32 gets introduced to compress hollow 36 of block 14 the piston sliding inside a cylinder 33 integral with the plate 30 by means of screws 34.

FIG. 3 shows the plate-like rod 19 which has the function of pressing, i.e. blocking, the fabric folded on the flat lance upon the translation plate 1.

For this purpose, the counter flat lance stands by the clamp so as to allow the needle to pass through slot 7, i.e. so as to allow darts to be sewn in the interspace between the flat lance and the plate-like rod.

Also the counter flat lance 19 is provided with an additional element 19.1 by which it is connected with the base 18 of device 13 having the same features as the one shown in FIG. 2A; the rest surface of plate-like rod 19 is provided with a layer 25 made of rubber, felt or any other suitable material so as to facilitate the blocking of the below situated fabric T.

FIG. 4 shows the set made up of plate 1, flat lance 9 and plate-like rod 19 before the beginning of the dart sewing process, i.e. the figure shows the fabric T folded on flat lance 9, and plate-like rod 19 before pressing the fabric upon the translation plate 1.

In order to facilitate the application of the fabric to the flat lance, the fabric has cuts Ti which mark the boundaries of the dart to be sewn.

FIGS. 7A–D illustrates the phases of the sewing operation.

The phase shown in FIG. 7A shows flat lance 9 lifted above the translation plate 1 so as to allow the area of fabric T marked by cuts Ti to be folded on the clamp; counter flat lance 19 as well is lifted above the translation plate.

In the phase shown in FIG. 7B, flat lance 9, with the fabric thereupon folded, touches plate 1 in the area of the fabric where the dart is to be sewn and the plate-like rod is still lifted.

The phase shown in FIG. 7C illustrates the plate-like rod 19 lowered so as to hold the fabric to plate 1 and to allow the sewing operation by means of the needle A through an element 23 and slot 7.

At the end of the sewing operation, shown in FIG. 7D, flat lance 9 and counter flat lance 19 are lifted above the translation plate 1, so that the sewn dart may be removed from the sewing machine.

The removal is automatically provoked by means of a pneumatic device blowing an air jet into bush 24 provided with a threaded connection 24.1.

Lances 9, 10 and 11 are provided, at one of their ends, with the air device 24.

FIG. 8 shows more in detail the phase shown in FIG. 7B of the dart sewing operation, before lowering the blocking plate-like rod 19; in the figure air device 24 is well illustrated.

Figure 9A:
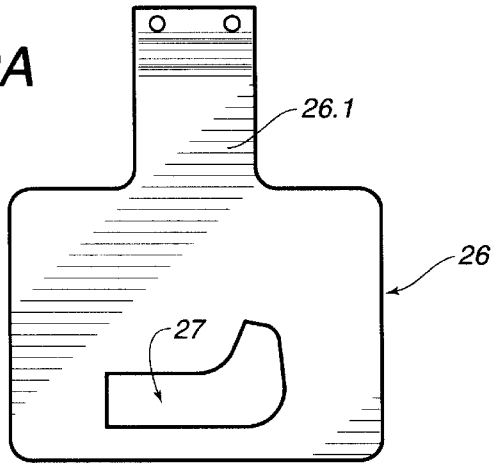
FIGS. 9A and 9B show respectively plan and side views of the set made up of the translation plate, the flat lance and the counter and plate-like rod intended for straight closed darts.
Figure 9B:
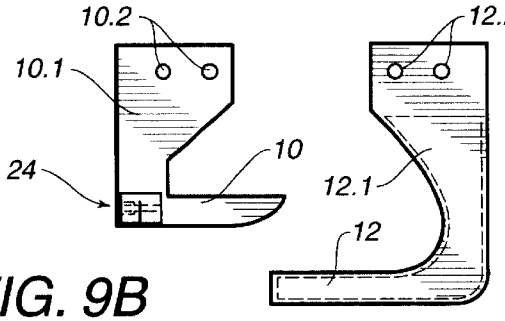
Figure 10:
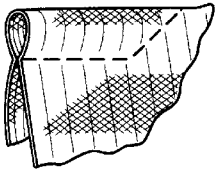
FIG. 10 shows the closed dart sewn by means of the set illustrated in FIG. 9A and 9B.

FIGS. 9A and 9B shows a translation plate 26 provided with slot 27 having a rounded end for straight closed darts as illustrated in FIG. 10.

The plate 26 is provided with an additional element 26.1 to allow the application to a smaller plate similar to the above described plate 2 to which the translation plate 1 is connected; flat lance 10 has a rounded end for closed darts.

The flat lance has an additional plate-like element 10.1 having holes 10.2 which allow the flat lance to be connected to the base 18 of the vertical frame 13 which blocks the flat lance itself to bearing device 21 integral with the feed mechanism of the sewing machine; the plate-like rod which allows closed darts to be sewn is similar to the one used for pointed darts.

It is made up of a straight narrow plate 12 having an underlying layer of a material suitable for allowing the below-situated fabric to be held to the translation plate, the plate-like rod being provided with an additional plate-like element 12.1 having holes 12.2 which allow the plate-like rod to be connected to the base 18 of the second guide member which blocks it to bearing device 21.

Features of closed darts are shown in FIG. 10.

Figure 11:
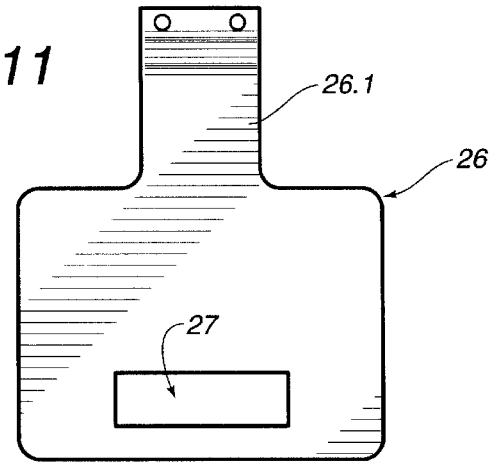
FIG. 11 shows the translation plate intended for straight open darts.
Figure 13:
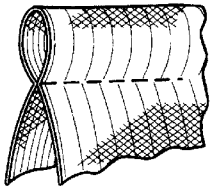
FIG. 13 shows the dart sewn by means of the set shown in FIGS. 11 and 12.

Straight open darts are sewn by using a translation plate similar to the one used for straight closed darts, said translation plate being provided with a rectangular (rather than rounded) slot 28 as well as by using flat lance 11 having quite parallel borders, see FIGS. 11, 12 and 13.

Also in this case, flat lance 11 has an additional element 11.1 with holes 11.2 which allow the flat lance to be connected to the base 18 of the blocking device; plate-like rod 20 has the same features as plate-like rod 19 and is provided with an additional element 20.1 with holes 20.2 so as to be connected to the base 18 of the second guide member.

Figure 15:
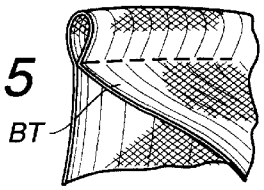
FIG. 15 shows the dart sewn by means of the clamp and the counter flat lance shown in FIG. 14.

FIG. 14 shows the flat lance and the plate-like rod 29 thereupon positioned so as to sew darts in proximity to pockets openings, for example at a distance of about 10 millimeters, by means of a translation plate 26, see the pocket border indicated as BT in FIG. 15.

The size of the various elements which form the set in its different embodiments depends on the size of the garment to be manufactured.

The slot allowing the needle to pass through, may also be structured according to other types of darts to be sewn. The present invention also refers to the whole sewing operation carried out by means of the so far described set.

Fabrics may be placed upon the flat lance from right to left or, vice versa, from left to right, by manufacturing flat lance having an inverted structure, i.e. by exchanging the position of the additional plate-like elements by which the flat lance and the plate-like rod get connected to the feed mechanism of the sewing machine, so that the ends of said flat lance and counter flat lance be turned in opposite directions; a different inclination of the slots through which the needle passes will also follow.

The enclosed drawings illustrate flat lance allowing fabrics to be placed from right to left.

FIGS. 17*a* and 17*b* show flat lance 37, i.e. a different embodiment of the flat lance, shaped so as to allow the borders of the protruding end of waist-bands, which gets buttoned up to said waist-bands other end in trousers or skirts, to be sewn on the reverse side; for this purpose, flat lance 37 has a pointed end 37.1 and is provided with an additional plate-like element 37.2, by which the flat lance gets connected to the base 18 of the blocking first guide member. After superposing the ends of the two fabric bands forming the waist-band upon a special plate-like rod 38.1 of the translation plate 38 for sewing the protruding end of the waist-band, flat lance 37.1 is lowered so as to get exactly superposed to said similarly shaped plate-like rod 38.1.

After sewing the borders of said protruding end on the reverse side through slot 39, the protruding end gets turned on the right side.

By means of screws 18.1, plate 38 gets applied to base 18 of the vertical frame 13 of the first guide member which allows the plate to be connected to bearing device 21.

What is claimed is:

1. An apparatus applied to an automatic programmable sewing unit for forming darts by a folding of a piece of fabric, the apparatus comprising:

a flat translation plate connectable to a feed mechanism of the sewing unit such that said plate is slidable in parallel relation to a working surface of the sewing unit;

a flat lance having a plate-like extension extending transverse thereto;

a first guide member having said flat lance connected by a guide bearing thereto such that said flat lance is controllably movable from said translation plate upwardly therefrom and movable downwardly thereto;

a plate-like rod having a plate-like extension extending generally transverse thereto;

a second guide member having said plate-like rod connected by a guide bearing thereto such that said second guide member is controllably movable from said translation plate upwardly therefrom and movable downwardly thereto, said plate-like rod having an edge in spaced relation to an edge of said flat lance;

a channel formed in said flat lance and having an opening at a surface of said flat lance; and pneumatic means connected to said channel for passing pressurized air through said channel to separate fabric from a surface of said flat lance.

2. The apparatus of claim 1, said translation plate having a slot formed therein, said translation plate having a plate member affixed thereto defining a seat for the fabric, said translation plate further comprising a plate-like extension extending therefrom, the apparatus further comprising:

a plate element having holes formed therein, said plate element affixed to an end of said plate-like extension opposite said translation plate, said holes having a size suitable for receiving therein pins of the feed mechanism of the sewing unit so as to move said translation plate over the working surface.

3. The apparatus of claim 1, said flat lance having a curved cross-section and straight convergent edges for forming angled darts.

4. The apparatus of claim 1, said flat lance having parallel edges for forming straight darts.

5. The apparatus of claim 1, said second guide member having means for moving said plate-like rod downwardly such that overlapping sections of fabric are fixedly interposed between a bottom surface of said plate-like rod and a top surface of said translation plate.

6. The apparatus of claim 1, said plate-like extensions of said flat lance and said plate-like rod having holes formed therein so as to allow connection to the feed mechanism of the sewing unit, said first guide member comprising;

a vertical frame;

a block affixed to said vertical frame, said block having horizontal holes formed therein.

7. The apparatus of claim 6, said first guide member having a hollow formed in said block, said block having a plate affixed thereto, said plate of said block having a hole formed therein, said hole of said plate of said block allowing a piston to pass therethrough, said piston being driven by a cylinder secured by screws to said block.

8. The apparatus of claim 1, said translation plate being secured to an air piston drive by a cylinder so as to be secured to the feed mechanism.

9. A process for sewing a dart to a garment comprising:

folding an area of a fabric onto a flat lance of a desired shape;

positioning the folded area of the fabric on a translation plate;

pressing overlapping sections of the folded area of the fabric with a plate-like rod;

sliding said translation plate over a working surface of a sewing unit such that said area of said fabric moves toward a needle of the sewing unit;

sewing the overlapping sections of the folded area of fabric without the fabric touching the working surface of the sewing unit, said step of sewing occurring by passing a needle through the overlapping sections and through a slot in said translation plate; and injecting air through said flat lance so as to separate the fabric from a surface of said flat lance.

10. The process of claim 9, further comprising:

forming two cuts on an edge of said area of fabric;

manually folding a section of fabric marked by said two cuts over said flat lance;

lifting said flat lance with the folded section of material a distance above said translation plate;

lowering said flat lance toward said translation plate such that said section of fabric touches said translation plate;

lowering a plate-like rod so as to press the overlapping sections against said translation plate;

sewing the dart by moving said translation plate forward under the needle of the sewing unit; and lifting said flat lance and said plate-like rod from said translation plate.

* * * * *